US008387410B2

(12) United States Patent
Cho et al.

(10) Patent No.: US 8,387,410 B2
(45) Date of Patent: Mar. 5, 2013

(54) AIR COOLING TYPE CHILLER

(75) Inventors: Nam-Joon Cho, Seoul (KR); Gi-Seop Lee, Seoul (KR); Bon-Chang Hwang, Seoul (KR); Jong-Ho Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 413 days.

(21) Appl. No.: 12/725,606

(22) Filed: Mar. 17, 2010

(65) Prior Publication Data

US 2011/0120171 A1 May 26, 2011

(30) Foreign Application Priority Data

Nov. 23, 2009 (KR) ..... 10-2009-0113485

(51) Int. Cl.
*F25D 17/06* (2006.01)

(52) U.S. Cl. ..... 62/428; 62/498

(58) Field of Classification Search ..... 62/426, 62/298, 498, 132, 183, 259.1, 428
See application file for complete search history.

(56) References Cited

U.S. PATENT DOCUMENTS 4,404,814 A * 9/1983 Beasley et al. ..... 62/171
6,161,312 A * 12/2000 Yang ..... 34/565
6,606,872 B1 8/2003 Smith
2002/0014088 A1* 2/2002 Seki et al. ..... 62/498
2007/0101739 A1* 5/2007 Akei et al. ..... 62/238.6
2008/0083237 A1* 4/2008 Street et al. ..... 62/196.4
2009/0249823 A1* 10/2009 Okuda et al. ..... 62/440

FOREIGN PATENT DOCUMENTS

| | | |
|---|---|---|
| EP | 1 645 829 | 4/2006 |
| JP | 5-296643 | 11/1993 |
| KR | 10-2003-0008707 | 1/2003 |
| WO | WO 99/64794 | 12/1999 |
| WO | WO 2007/015281 | 2/2007 |
| WO | WO 2009/014983 | 1/2009 |

OTHER PUBLICATIONS

European Search Report issued in EP Application No. 10167681.5 dated Mar. 31, 2011.
Korean Office Action issued in KR Application No. 10-2009-0113485 dated Nov. 8, 2011.

* cited by examiner

*Primary Examiner* — Mohammad Ali
(74) *Attorney, Agent, or Firm* — KED & Associates, LLP

(57) ABSTRACT

An air-cooling type chiller is provided. The chiller may include a plurality of fans, and an intermediate device provided between adjacent fans of the plurality of fans. When one of the fans is disabled, air is not drawn in through the disabled fan due to the intermediate device, but instead may pass through a condenser, thereby minimizing degradation in condensing efficiency. The intermediate device may be formed as an auxiliary condenser so that any air drawn in through a disabled fan passes through the auxiliary condenser, also minimizing impact on condensing efficiency.

13 Claims, 6 Drawing Sheets

AIR COOLING TYPE CHILLER

CROSS-REFERENCE TO RELATED APPLICATIONS

Pursuant to 35 U.S.C. §119(a), this claims the benefit of earlier filing date and right of priority to Korean Application No. 10-2009-113485 filed in Korea on Nov. 23, 2009, the entirety of which is incorporated herein by reference.

BACKGROUND

1. Field

An air cooling type chiller is provided, and more particularly, an air cooling type chiller that prevents air from entering into a disabled fan is provided.

2. Background

In general, chillers may be classified as a water-cooling type or an air-cooling type based on a heat carrier radiation method employed. The water-cooling type chiller scatters a heat carrier at a cooling tower to radiate heat, and the air-cooling type chiller brings air into contact with a heat carrier flowing exchanger to radiate heat.

The air-cooling type chiller may cool a heat carrier substantially at ambient temperature with minimum energy in response to a change in air temperature. However, a closed evaporation type cooling tower requires a number of different components, including, for example, a spray water tank, a storage water tank, a lift pump, and the like, and thus it has a complex configuration. Moreover, a source for supplying spray water is required, and thus installation locations may be limited. In addition, erosion or scale may be generated in the plumbing if the quality of supply water is bad, or in an installation environment including dust, smoke, salt, and the like, and therefore, periodic maintenance and inspection may be burdensome.

An air-cooling type chiller does not require a spray water tank or storage water tank because water is not sprayed on the heat pipe. Accordingly, erosion or scale is not generated in an air-cooling type chiller, and maintenance may be simplified compared to a water-cooling type chiller. Furthermore, a pump for supplying coolant is not required and thus it may be possible to reduce power consumption.

BRIEF DESCRIPTION OF THE DRAWINGS

The embodiments will be described in detail with reference to the following drawings in which like reference numerals refer to like elements wherein.

DETAILED DESCRIPTION

Figure 1:
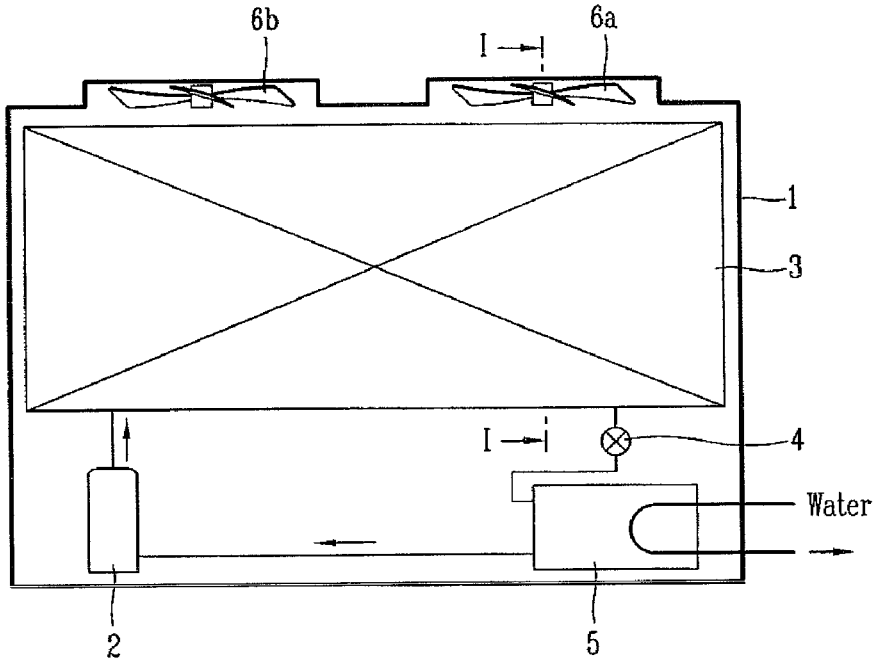
FIG. 1 is a schematic illustration of an exemplary air-cooling type chiller.
Figure 2:
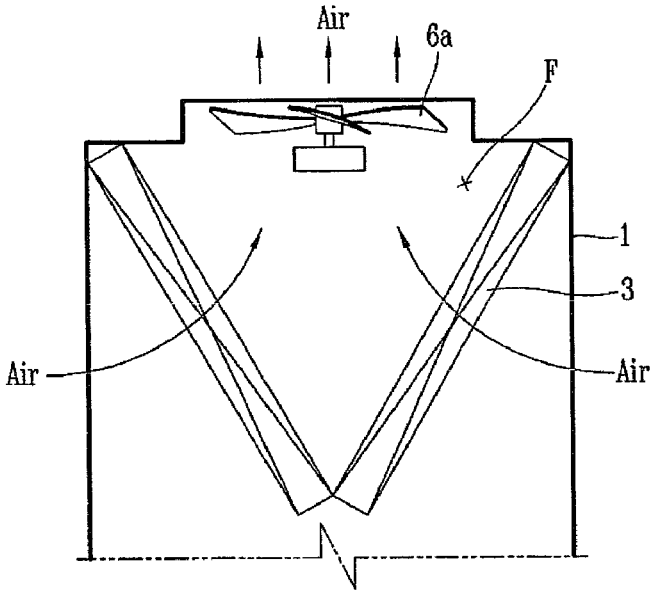
FIG. 2 is a cross-sectional view taken along line "I-I" of FIG. 1.

An exemplary air-cooling type cooling apparatus (hereinafter, air-cooling type chiller) is shown in FIG. 1. The air-cooling type chiller may include a refrigeration cycle including a compressor 2, a condenser 3, an expansion valve 4, and an evaporator 5 provided within a case 1. A plurality of fans 6*a*, 6*b* that provide for air flow into and out of the case 1 to exchange heat with the condenser 3 may be provided at an upper or lateral surface of the case 1. As shown in FIG. 2, a plurality of condensers 3 may be provided in a V-shape at both front and rear sides, and the fans 6*a*, 6*b* may be arranged along an upper opening between the two condensers 3.

In such an air-cooling type chiller, refrigerant compressed at high-temperature and high-pressure in the compressor 2 is radiated by using air as a heat carrier in the condenser 3 and becomes a low-temperature, low-pressure refrigerant that is exchanged with water in the evaporator 5. The exchanged water is supplied for use as a cooling source. When so configured, if the fans 6*a*, 6*b* operate, then outside air is drawn into the case 1, passes through the compressor 2, and then passes again through the fans 6*a*, 6*b* to be exhausted out of the case 1.

Figure 3:
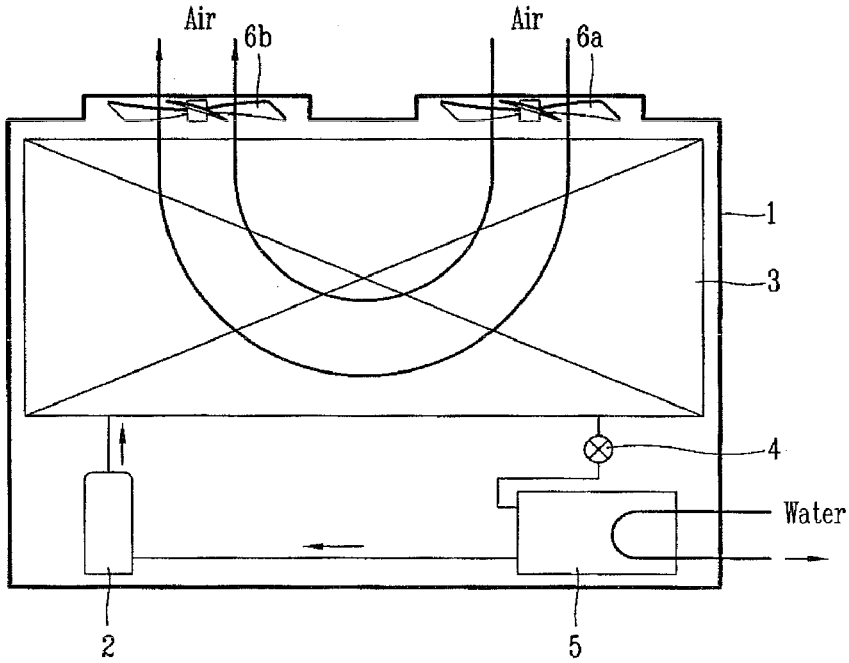
FIG. 3 is a schematic illustration of an air flow through air-cooling type chiller shown in FIG. 1 when one of the fans is disabled.

In this air-cooling type chiller, a space between the two fans 6*a*, 6*b*, that is, an air path (F), is open. As a result, when either one of the fans 6*a*, 6*b* is disabled and does not operate, as shown in FIG. 3, air does not pass through the condenser 3 but instead is drawn in through the disabled fan 6*b* and then exhausted through the other (operable) fan 6*a*, thereby greatly reducing the refrigerating capacity of the chiller. In other words, the opening area of the fan 6*b* is wider than that of the condenser 3, and therefore, when the fan 6*b* does not operate, the flow resistance of the disabled fan 6*b* is smaller than that of the condenser 3, and accordingly, air does not pass through the condenser 3 but is drawn in through the disabled fan 6*b* and exhausted out through the operating fan 6*a*. Due to this effect, outside air is not brought into contact with the condenser 3, and thus the heat exchange efficiency of the condenser 3 may be reduced, thereby greatly reducing the refrigerating capacity of the chiller.

Figure 4:
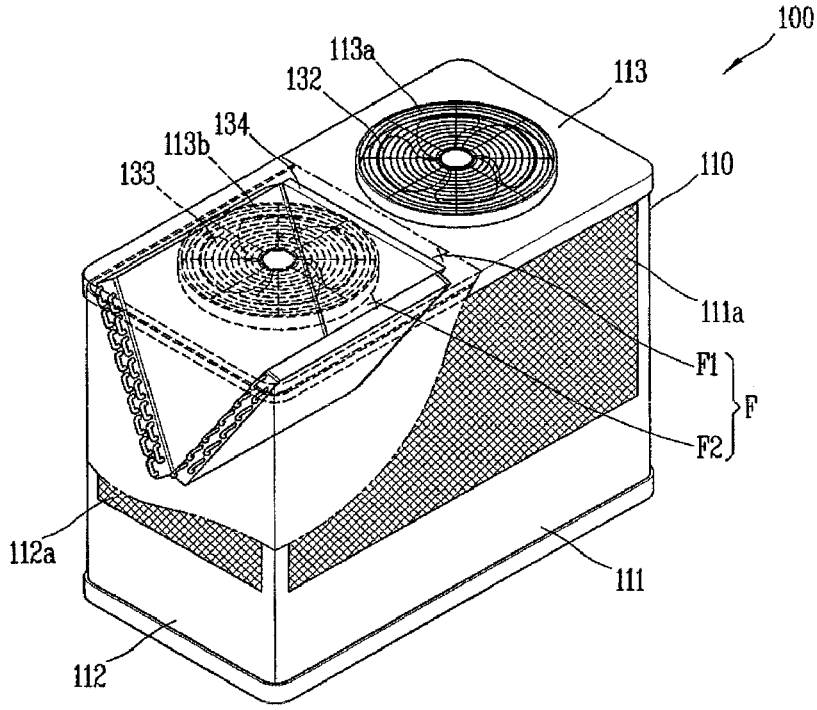
FIG. 4 is a partial cutaway perspective view of an exemplary air-cooling type chiller in accordance with an embodiment as broadly described herein.

As shown in FIG. 4, an air-cooling type chiller 100 as embodied and broadly described herein may include a case 110, a cool air generator 120, and a heat exchanger 130 provided in an upper inner space of the case 110.

The case 110 may have a hexahedral shape having front and rear sidewall surfaces 111, left and right sidewall surfaces 112, and top and bottom sidewall surfaces 113. An air intake port 111*a*, which is an inlet-side opening, may be formed at the front and/or rear sidewall surfaces 111. A through port 112*a* may be formed at the left and/or right sidewall surfaces 112. Air discharge ports 113*a*, 113*b*, which are outlet-side openings, may be formed at the top sidewall surface 113. A first fan 132 and a second fan 133 may be provided at the air discharge ports 113*a*, 113*b*, respectively, arranged in a horizontal direction and spaced apart from each other by a predetermined distance.

The cool air generator 120 may be, for example, a compressor 121 for compressing an evaporated refrigerant and discharging the compressed refrigerant to a condenser 131 of a heat exchanger 130. The cool air generator 120 may be provided at a bottom surface of the case 110. An expansion valve 122 for decompressing a refrigerant liquefied in the condenser 131 may be provided between the condenser 131 and an evaporator 123, and the evaporator 123 may be sequentially connected and provided between the expansion valve 122 and the compressor 121 to form a closed flow path. The evaporator 123 may be provided and connected to an external device to circulate a heat carrier, such as, for example, water, heat-exchanged with a cooled refrigerant in the evaporator 123.

In certain embodiments, a single compressor 121, expansion valve 122, and evaporator 123 may be provided. In alternative embodiments, plural units may be provided based on the capacity requirements of a particular system.

The heat exchanger 130 may include at least one condenser 131 provided inside the case 110, and fans 132, 133 respectively provided at the air discharge ports 113*a*, 113*b* of the case 110 for discharging air that has passed through the condenser 131.

The condenser 131 may be formed in various ways based on the number of chiller units provided in a particular system, each of the individual chiller units having a cool air generator and a heat exchanger within a case.

Figure 5:
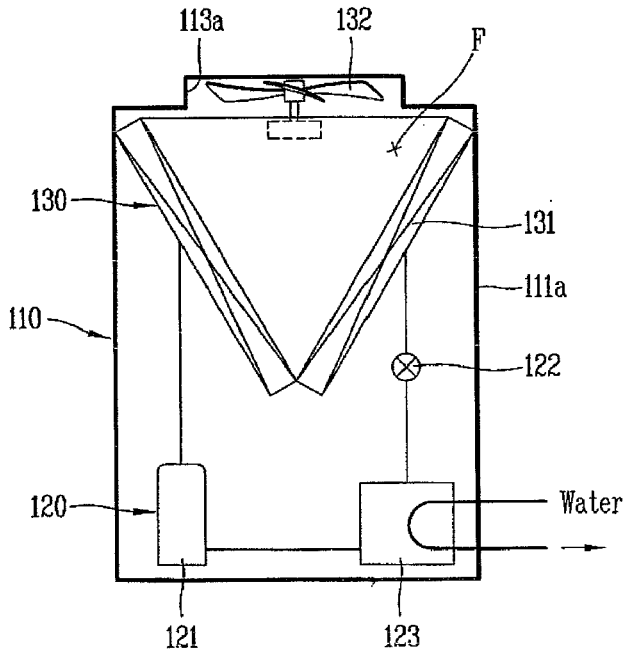
FIG. 5 is a cross-sectional view taken from a lateral side of the air-cooling type chiller shown in FIG. 4.

For example, when a system includes a single chiller, air intake ports may be formed at any/all of the front, rear, left, and right sidewall surfaces, and thus the condenser may be positioned in a vertical direction along the front, rear, left, and right sidewall surfaces. When a system includes a plurality of chiller units provided adjacent to one another, the condenser may be positioned at an incline, because air may not flow into a chiller unit placed at the center of the chiller units when the condenser is positioned in a vertical direction. In other words, as illustrated in FIG. 5, the condenser 131 may be formed in a V-shape such that the distance between opposite sides of the condenser 131 becomes narrower from top to bottom corresponding to both front and rear sidewall surfaces 111 respectively, and thus forming an air path (F) therebetween.

In certain embodiments the condenser 131 may include a refrigerant pipe formed with a plurality of bends, and a plurality of radiation members provided at predetermined intervals in a length direction of the refrigerant pipe.

As discussed above, the first fan 132 and the second fan 133 may be respectively provided individually in the air discharge ports 113*a*, 113*b*. The first fan 132 and the second fan 133 may be provided at an upper side of the condenser 131 having a wide distance between opposite ends of the condenser 131 in order to discharge air that has passed through the condenser 131.

Figure 6:
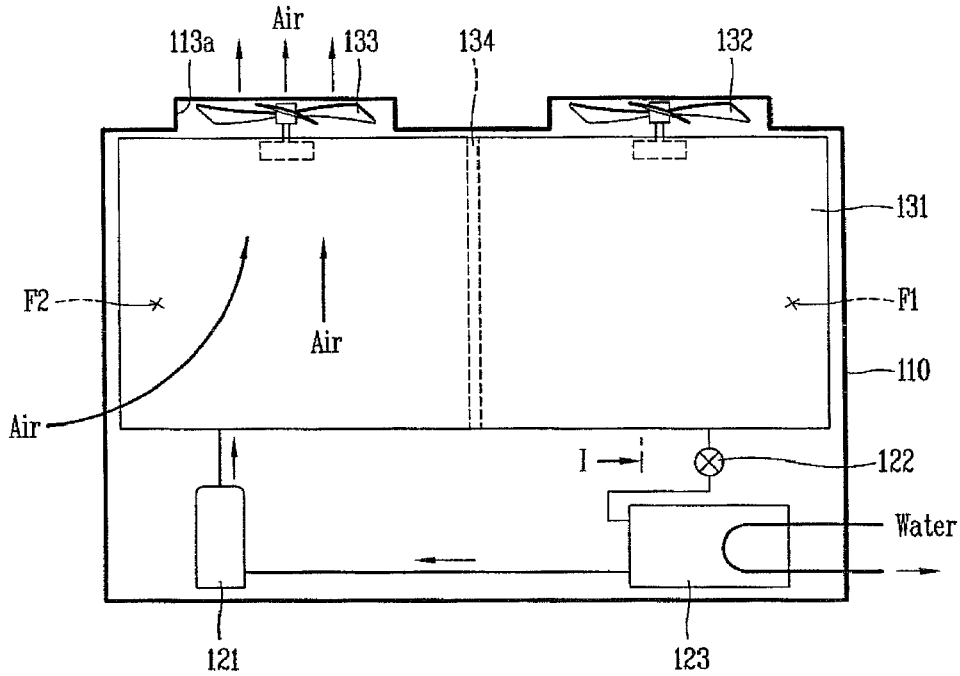
FIG. 6 is a schematic illustration of air flow through the air-cooling type chiller shown in FIG. 4 when one of the fans is disabled.

An intermediate device, or divider, may be positioned in the air path (F) between the two opposite sides of the condenser 131, between the first fan 132 and the second fan 133, so as to partition the air path (F) into a first air path (F1) and a second air path (F2). In certain embodiments, the intermediate device, or divider, may be formed as a shielding plate 134 which may be positioned in a direction vertical to a wide plane of the condenser 131. Such a shielding plate 134 may be formed as a flat-plate-shaped body as illustrated in FIGS. 4 and 6. When the first fan 132 or the second fan 133 is disabled, the shielding plate 134 prevents air from being drawn in through the disabled fan (the first fan 132 as shown in FIG. 6).

In certain embodiments, the shielding plate 134 may be formed of a metal material. In alternative embodiments, it may be formed of a plastic material to reduce cost and potential erosion.

Figure 10:
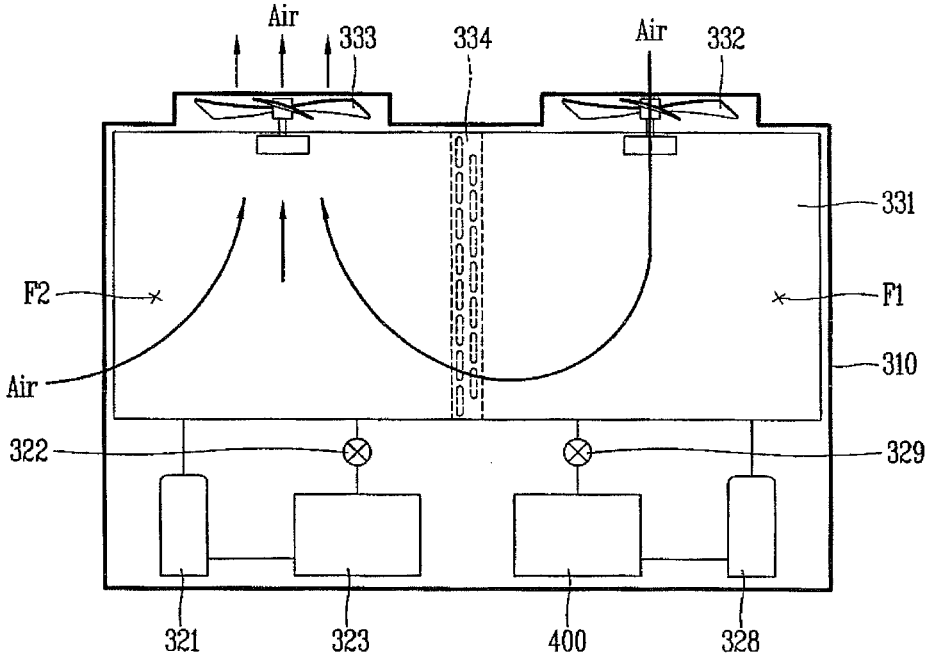
FIG. 10 is a schematic illustration of air flow through the air-cooling type chiller shown in FIG. 9 when one of the fans is disabled.

In certain embodiments, the shielding plate 134 may be formed such that air is not allowed to pass therethrough. In alternative embodiments, it may be formed with small pores (see FIG. 10) that allow a very small amount of air to pass therethrough. The sectional area of such pores may be less than those formed in the air intake port.

During operation, when the compressor 121 operates to compress a refrigerant and then provides the compressed refrigerant to the condenser 131, the compressed refrigerant is heat-exchanged with outside air, condensed in the condenser 131 and then sent to the evaporator 123 through the expansion valve 122. The condensed and expanded refrigerant is heat-exchanged with outside air, evaporated in the evaporator 123 and then sent to the compressor 121 to be compressed again.

During this process, outside air is drawn in through the air intake port 111*a* formed at both front and rear sidewall surfaces 111 of the case 110 by the intake force generated by the first fan 132 and the second fan 133 positioned at the upper side of the condenser 131. The outside air passes through the condenser 131, which faces both front and rear sidewall surfaces 111 of the case 110, and is exhausted to the outside again through each of the fans 132, 133.

However, when the first fan 132 or the second fan 133 is disabled, air cannot be drawn in by the disabled fan due to the positioning of the shielding plate 134, thereby preventing any reduction in the condensing efficiency of the condenser 131 due to the disabled fan.

For example, when the first fan 132 is disabled for some reason, as shown in FIG. 6, the first fan 132 may serve as a kind of inlet-side opening, that is, an air intake port. In particular, the opening area of the first fan 132 is wider than that of the air intake port 111*a* provided at the front and/or rear sidewall surfaces 111 of the case 110, and thus the flow resistance of the first fan 132 in fact becomes smaller that that of the air intake port 111*a* at both front and rear sidewall surfaces 111. As a result, when the second fan 133 operates while the first fan 132 is disabled, without a shielding plate 134, air would not be drawn in through the air intake port 111*a*. Instead, air would be drawn into an air path defined by the first fan 132, which has a relatively low flow resistance, and would then be exhausted through the first fan 132. In this situation, air is not brought into contact with the condenser 131, and thus the condensing efficiency of the condenser 131 may be drastically reduced.

However, in an air-cooling type chiller as embodied and broadly described herein, an air path (F) between the first fan 132 and the second fan 133 is partitioned into a first path space (F1) and a second path space (F2) by the shielding plate 134. Thus, operation of each of the fans 132, 133 may affect only its respective air path (F1, F2). As a result, as illustrated in FIG. 6, even if the second fan 133 operates when the first fan 132 is disabled, outside air is not drawn into an air path through the first fan 132 but instead passes through part of the air intake port 111*a* and a part of the condenser 131 corresponding to a region of the second path space (F2), flows into the second path space (F2) and is then exhausted through the second fan 133, thereby preventing the condensing efficiency of the condenser 131 from being drastically reduced.

Figure 7:
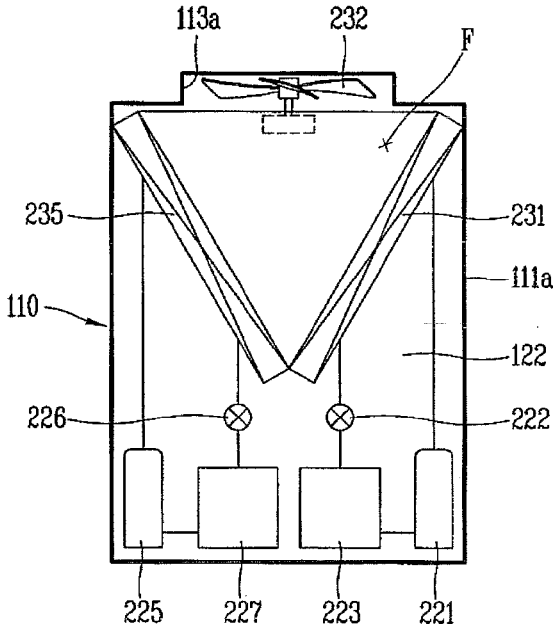
FIG. 7 is a cross-sectional view taken from a lateral side of another embodiment of an air-cooling type chiller as broadly described herein.

In the embodiment shown in FIG. 5, the condenser 131 is bent in the middle of the refrigerant pipe so as to form a single refrigeration cycle, and thus may have an integrated form. In the embodiment shown in FIG. 7, the unit may include a first condenser 231 and a second condenser 235 in order to form independent refrigeration cycles having individual compressors 221, 225, expansion valves 222, 226, and evaporators 223, 227, respectively.

Figure 8:
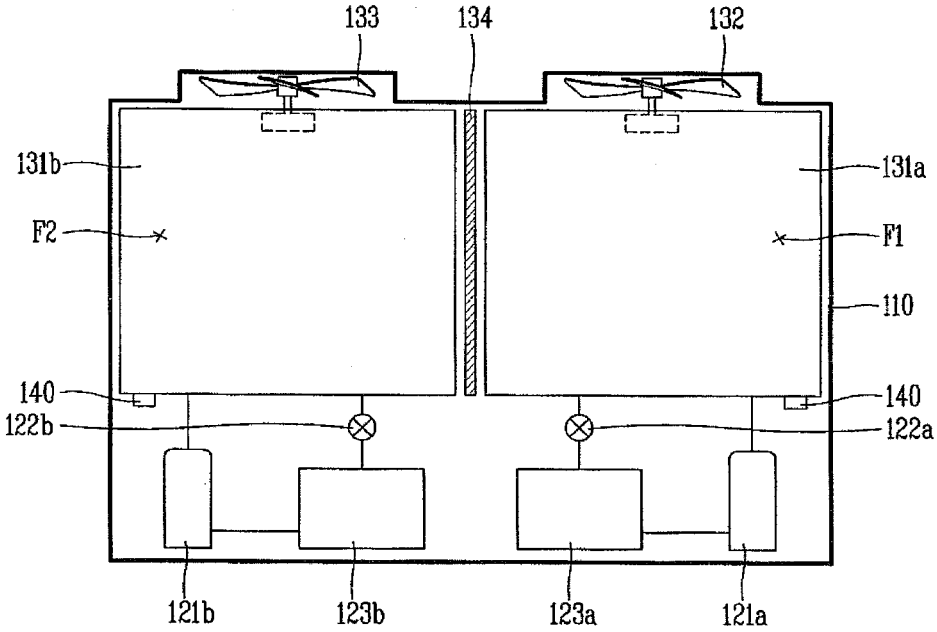
FIG. 8 is a cross-sectional view taken from a front side of another embodiment of an air-cooling type chiller as broadly described herein.

In the embodiment shown in FIG. 8, the condenser 131 shown in FIGS. 5 and 6 is divided into a first condenser 131*a* and a second condenser 131*b* by the shielding plate 134, that is, by corresponding to the first path space (F1) and the second path space (F2). The first condenser 131*a* and the second condenser 131*b* may form independent refrigeration cycles having individual compressors 121*a*, 121*b*, expansion valves 122*a*, 122*b*, and evaporators 123*a*, 123*b*, respectively.

In this case, thermal sensors 140 may be provided to detect an outside temperature of the condensers 131*a*, 131*b* respectively. The thermal sensors 140 may be electrically connected to a controller that turns a power supply on or off to the first fan 132 or the second fan 133, that is, to a disabled fan, based on the value detected by each thermal sensor 140.

As a result, it may be possible to block power from being applied to the disabled fan, thereby reducing unnecessary power consumption. Moreover, the controller may include a display for displaying a failure state of the fan, thereby allowing an administrator to quickly provide maintenance for the disabled fan.

An air-cooling type chiller according to another embodiment will be described as follows.

The foregoing embodiment includes an intermediate device, or divider, formed by the shield plate 134 that partitions the first path space F1 and the second path space F2 into independent regions. In the embodiment shown in FIGS. 9 and 10, the intermediate device includes an auxiliary condensing heat exchanger (hereinafter, an auxiliary condenser 334) in which air may flow between the first path space (F1) and the second path space (F2). In this embodiment, when either one of the fans (for example, a first fan 332) is disabled, air flows in through the disabled first fan 332, and passes through the auxiliary condenser 334 due to the operation of a second fan 333 while being heat-exchanged as it passes through the auxiliary condenser 334, thereby enhancing the overall condensing efficiency.

In certain embodiments, the auxiliary condenser 334 may be connected together with a main condenser 331 to form a single refrigeration cycle. In alternative embodiments, as illustrated in FIG. 9, the auxiliary condenser 334 may form an independent refrigeration cycle that is distinguishable from the main condenser 331.

When the auxiliary condenser 334 forms an independent refrigeration cycle from the main condenser 331, the unit may be controlled to suspend a refrigeration cycle (for example, a first refrigeration cycle) including the main condenser 331 and perform only a refrigeration cycle (for example, a second refrigeration cycle) including the auxiliary condenser 334.

Figure 9:
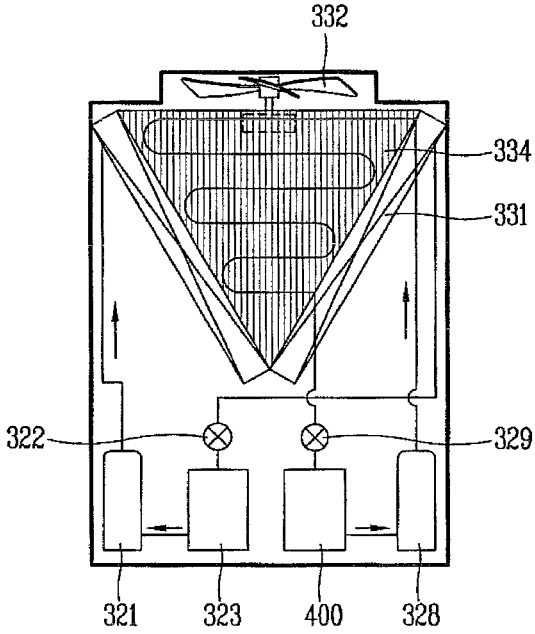
FIG. 9 is a cross-sectional view taken from a front side of another embodiment of an air-cooling type chiller as broadly described herein.
Figure 11:
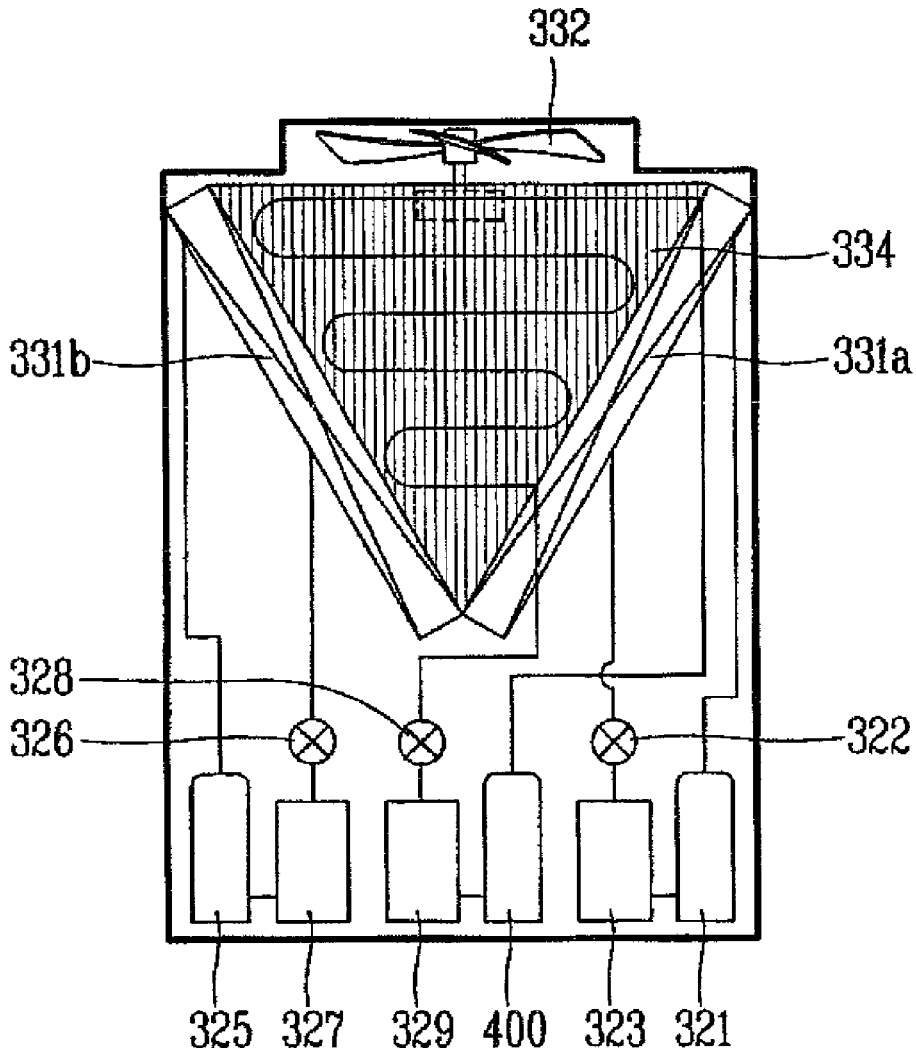
FIG. 11 is a cross-sectional view taken from a lateral side of another embodiment of an air-cooling type chiller as broadly described herein.

As shown in FIG. 9, the main condenser 331 may be bent in the middle of the refrigerant pipe so as to have a single, integrated form. Alternatively, as shown in FIG. 11, the main condenser 331 may be divided into a first condenser 331*a* and a second condenser 331*b* so as to form independent refrigeration cycles having individual compressors 321, 325, expansion valves 322, 326, and evaporators 323, 327, respectively.

On the other hand, though not shown in detail, in this embodiment, as similar to the foregoing embodiment shown in FIG. 8, the condenser 331 may be divided into a first condenser and a second condenser by a shielding plate 334, corresponding to the first path space (F1) and the second path space (F2). Such a first condenser and second condenser may form independent refrigeration cycles having individual compressors, expansion valves, and evaporators, respectively.

In an air-cooling type chiller as embodied and broadly described herein, in a case in which a plurality of fans are provided, an intermediate device, or divider may be provided between the plurality of fans, and thus when one of the fans is disabled, air is not drawn in through the disabled fan but instead through a condenser, thereby preventing the condensing efficiency of the condenser from being greatly reduced. Such an intermediate device, or divider, may be formed as an auxiliary condenser, and thus even if air is drawn in through a disabled fan, the air may pass through the auxiliary condenser and heat-exchanged, thereby preventing the condensing efficiency of the condenser from being reduced.

In an air-cooling type chiller as embodied and broadly described herein, a plurality of unit chillers as described above may be arranged adjacent to one another in a small-sized building, and also multiple unit chillers may be arranged adjacent to one another in a large-sized building.

An air-cooling type chiller is provided in which outside air is not inhaled through a disabled intake fan but inhaled through a condenser even if some of intake fans are disabled in an air-cooling type chiller that is provided with a plurality of intake fans.

An air-cooling type chiller as embodied and broadly described herein may include a case provided with an inlet-side opening and an outlet-side opening and formed with an inner space for making an air path between the inlet-side opening and the outlet-side opening; at least one condensing heat exchangers provided adjacent to the inlet-side opening of the case, having a pipeline for flowing a refrigerant, and heat exchanging the refrigerant flowing through the pipeline with air to make part of a refrigeration cycle; a plurality of intake fans provided at regular intervals in a horizontal direction at the outlet-side opening of the case such that air is inhaled into the inner space through the inlet-side opening and the condensing heat exchanger and then exhausted out via the outlet-side opening; and an intermediate member provided at the air path between the plurality of intake fans for allowing the air path to be divided into a plurality of path spaces for accommodating the intake fans respectively.

An air-cooling type chiller in accordance with another embodiment as broadly described herein may include a case provided with an inlet-side opening and an outlet-side opening and formed with an inner space for making an air path between the inlet-side opening and the outlet-side opening; at least one condensing heat exchangers provided adjacent to the inlet-side opening of the case, having a pipeline for flowing a refrigerant, and heat exchanging the refrigerant flowing through the pipeline with air to make part of a refrigeration cycle; a plurality of intake fans provided at regular intervals in a horizontal direction at the outlet-side opening of the case such that air is inhaled into the inner space through the inlet-side opening and the condensing heat exchanger and then exhausted out via the outlet-side opening; and an intermediate member provided at the air path between the plurality of intake fans for allowing the air path to be divided into a plurality of path spaces for accommodating the intake fans respectively, wherein the intermediate member is formed with a shielding member for blocking air flow between both path spaces.

An air-cooling type chiller in accordance with another embodiment as broadly described herein may include a case provided with an inlet-side opening and an outlet-side opening and formed with an inner space for making an air path between the inlet-side opening and the outlet-side opening; at least one condensing heat exchangers provided adjacent to the inlet-side opening of the case, having a pipeline for flowing a refrigerant, and heat exchanging the refrigerant flowing through the pipeline with air to make part of a refrigeration cycle; a plurality of intake fans provided at regular intervals in a horizontal direction at the outlet-side opening of the case such that air is inhaled into the inner space through the inlet-side opening and the condensing heat exchanger and then exhausted out via the outlet-side opening; and an intermediate member provided at the air path between the plurality of intake fans for allowing the air path to be divided into a plurality of path spaces for accommodating the intake fans respectively, wherein the intermediate member is formed with an auxiliary condensing heat exchanger having a pipeline for flowing a refrigerant and exchanging the refrigerant flowing through the pipeline with air to make part of the refrigeration cycle.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air-cooling type chiller, comprising:

a case that defines an inner space, the case including an inlet-side opening and an outlet-side opening and an air path formed therebetween;

at least one condenser provided adjacent to the inlet-side opening;

a plurality of fans provided at the outlet-side opening; and a divider positioned so as to divide the air path into a plurality of path spaces corresponding to the plurality of fans, wherein the divider is positioned so as to obstruct air flow between adjacent fans of the plurality of fans, and wherein the divider has a plurality of pores extending therethrough.

2. The air-cooling type chiller of claim 1, wherein a plurality of cases are provided adjacent to one another, and a corresponding plurality of condensers are provided therein, each having first and second portions positioned at an incline within a respective case so as to have a V-shaped cross section.

3. The air-cooling type chiller of claim 2, wherein the plurality of fans are positioned adjacent to the outlet-side opening at a top end of the respective condenser, and wherein the divider extends downward from between adjacent fans of the plurality of fans at the outlet-side opening toward the respective condenser.

4. The air-cooling type chiller of claim 1, further comprising at least one compressor, at least one expansion valve, and at least one evaporating heat exchanger provided together with the at least one condenser in the inner space of the case so as to form at least one refrigeration cycle.

5. The air-cooling type chiller of claim 4, wherein the at least one condenser comprises a plurality of condensers, and each of the plurality of condensers forms an individual refrigeration cycle.

6. The air-cooling type chiller of claim 1, wherein the at least one condenser comprises a plurality of condensers forming a respective plurality of independent refrigeration cycles, and wherein each of the plurality of independent refrigeration cycles corresponds to one of the plurality of path spaces based on a position of the divider.

7. The air-cooling type chiller of claim 6, further comprising a plurality of thermal sensors respectively provided with the plurality of condensers to detect a corresponding temperature, wherein each of the plurality of thermal sensors is electrically connected to a controller that selectively applies power to the plurality of fans based on the temperature detected by each of the plurality of thermal sensors.

8. An air-cooling type chiller, comprising:

a case including an inlet-side opening and an outlet-side opening and an air path that extends therebetween;

at least one main condenser provided adjacent to the inlet-side opening and including a pipeline through which refrigerant flows so as to form a portion of a refrigeration cycle;

a plurality of fans provided adjacent to the outlet-side opening; and an auxiliary condenser positioned between adjacent fans of the plurality of fans, wherein the auxiliary condenser includes a pipeline through which refrigerant flows so as to operate independently from the at least one main condenser.

9. The air-cooling type chiller of claim 8, wherein the auxiliary condenser extends downward from the outlet-side opening toward the main condenser, and wherein the auxiliary condenser partitions the air path into a first path space on a first side thereof and a second path space on a second side thereof, the first and second path spaces respectively corresponding to the adjacent fans.

10. The air-cooling type chiller of claim 8, further comprising at least one compressor, at least one expansion valve, and at least one evaporating heat exchanger provided together with the at least one main condenser in the inner space of the case so as to form at least one refrigeration cycle.

11. The air-cooling type chiller of claim 10, wherein the at least one condenser comprises a plurality of main condensers, and wherein each of the plurality of main condensers forms an independent refrigeration cycle.

12. The air-cooling type chiller of claim 8, wherein each independent refrigeration cycle is formed based on a position of the auxiliary condenser.

13. The air-cooling type chiller of claim 12, further comprising a plurality of thermal sensors respectively provided with the plurality of main condensers to detect a corresponding temperature, wherein the plurality of thermal sensors are electrically connected to a controller that selectively applies power to the plurality of fans based on temperatures detected by the plurality of thermal sensors.

* * * * *